US009714112B1

(12) United States Patent
Lin

(10) Patent No.: US 9,714,112 B1
(45) Date of Patent: Jul. 25, 2017

(54) SEALING DEVICE FOR PAPER-BASED CONTAINER

(71) Applicant: Shih-Fong Lin, New Taipei (TW)

(72) Inventor: Shih-Fong Lin, New Taipei (TW)

( * ) Notice: Subject to any disclaimer, the term of this patent is extended or adjusted under 35 U.S.C. 154(b) by 0 days.

(21) Appl. No.: 15/207,518

(22) Filed: Jul. 12, 2016

(51) Int. Cl.
*B65D 43/22* (2006.01)
*B65D 5/54* (2006.01)
*B65D 5/02* (2006.01)

(52) U.S. Cl.
CPC ..... *B65D 5/541* (2013.01); *B65D 5/0236* (2013.01); *B65D 43/22* (2013.01); *B65D 2255/06* (2013.01)

(58) Field of Classification Search
CPC ..... B65D 5/0236; B65D 5/2066
USPC ..... 229/125.39
See application file for complete search history.

(56) References Cited

U.S. PATENT DOCUMENTS 3,306,521 A * 2/1967 Giacovas ..... B65D 5/0227 229/136
5,054,618 A * 10/1991 Kim ..... B65D 77/36 229/123.3
6,689,244 B2 * 2/2004 Schwertfeger ..... B65D 5/0236 156/247
6,951,301 B2 * 10/2005 Miaskiewicz, Jr. .. B65D 5/0236 229/125.37
6,991,838 B2 * 1/2006 Schwertfeger ..... B65D 5/0236 156/247
2004/0086711 A1 * 5/2004 Backman ..... B32B 27/12 428/354

* cited by examiner

*Primary Examiner* — Christopher Demeree
(74) *Attorney, Agent, or Firm* — Leong C. Lei

(57) ABSTRACT

The sealing device for a paper-based container has an elongated release base member with a double-sided adhesive layer on a major side along the length of the release base member. The release base member is adhered to a front portion of a flap of the container by the double-sided adhesive layer so that the flap may be used to seal the container. To open the container, a pull strip of the release base member is pulled off and the flap is separated. To reuse the container, a second sealing device is applied to another flap of the container so that the container may be reused.

5 Claims, 19 Drawing Sheets

SEALING DEVICE FOR PAPER-BASED CONTAINER

BACKGROUND OF THE INVENTION (a) Technical Field of the Invention

The present invention is generally related to container packaging, and more particular to a sealing device for sealing paper-based containers such as cartons, boxes, or envelopes so that these containers may be reused.

(b) Description of the Prior Art

For on-line store owners and electronic commerce operators, they usually package their products in a carton, a box, or an envelope (hereinafter, a container), seal the container with duct tape, and then ship the products out through couriers or forwarders. Postal and express delivery operators also follow similar processes.

When a customer receives such a container, he/she has to remove the duct tape, usually by tearing the duct tape off or by cutting off the duct tape with a knife. The container often suffers various degrees of damage and cannot be reused. This would be rather inconvenient when the customer would like to return the product using the same container. This is also not environmentally friendly as the damaged container is thrown away for not being able to be used again.

SUMMARY OF THE INVENTION

An objective of the present invention is to provide a sealing device for a paper-based container so that the container may be reused again after being used and opened.

The present invention is characterized in that an elongated release base member has double-sided adhesive layer on a major side along the length of the release base member. The release base member is adhered to a front portion of a flap of the container by the double-sided adhesive layer so that the flap may be used to seal the container. To open the container, a pull strip of the release base member is pulled off and the flap is separated. To reuse the container, a second sealing device is applied to another flap of the container so that the container may be reused.

The sealing device for a paper-based container includes a release base member of an elongate shape having a separation line along a length of the release base member separating the release base member into a base piece and a pull strip, and a double-sided adhesive layer having a first adhesive piece and a second adhesive piece on two major sides of the double-sided adhesive layer, respectively. The first adhesive piece is for adhering a major side of the release base member; the second adhesive piece is for adhering a front portion of a flap of the paper-based container; and, to apply the flap to seal the paper-based container, the base piece is removed from the release base member to reveal the first adhesive piece.

Preferably a number of protrusions are configured along a major edge of the base piece protruding perpendicularly to the major edge so that the base piece may be conveniently peeled off the release base member.

Preferably the base piece has a width greater than that of the pull strip so that the release base member may be reliably adhered to the front portion of the flap.

Preferably the first adhesive piece covers the pull strip entirely and the base piece partially so that the release base member may be reliably adhered to the front portion of the flap.

Preferably the protrusions are not covered by the first adhesive piece so that the base piece may be conveniently peeled off the release base member by the protrusions.

Preferably the front portion of the flap has two perforated lines of appropriate length along and parallel to two major edges of the pull strip, respectively, so that the pull strip may be conveniently pulled off In contrast to prior art, the release base member is adhered to a front portion of a flap of the container that seals the container. To open the container, a pull strip of the release base member is pulled off, the flap is separated, and the container is open. To reuse the container, a second sealing device is applied to another flap of the container so that the container may be reused.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
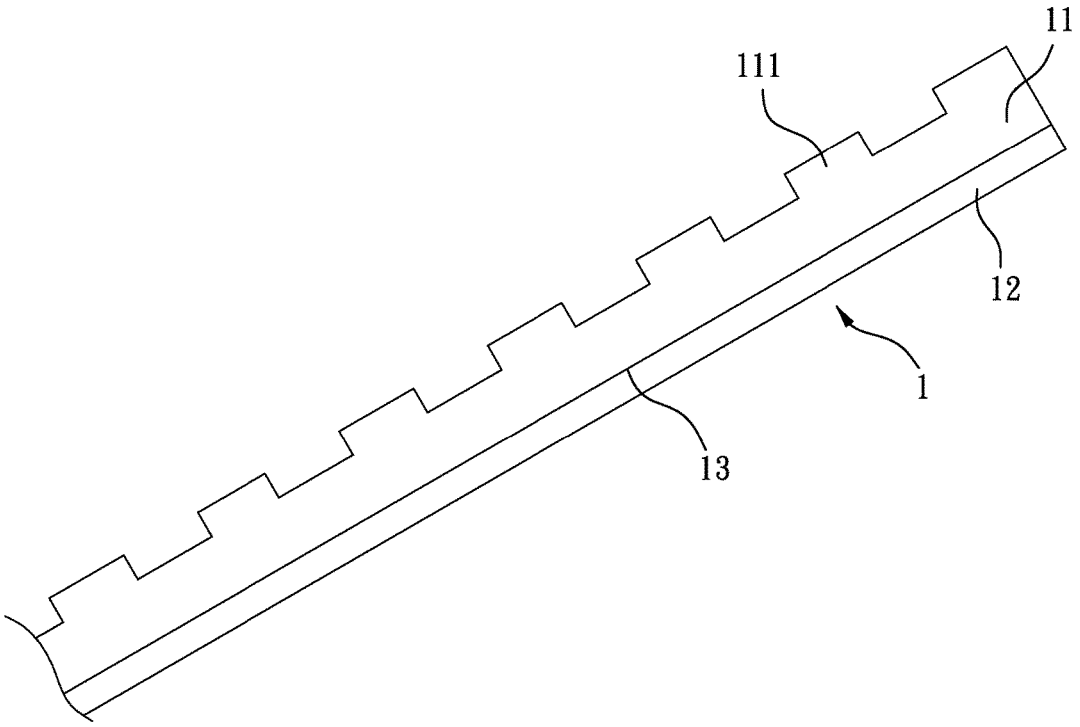
FIG. 1 is a planar diagram showing a release base member of a sealing device according to an embodiment of the present invention.

As illustrated in FIG. 1, a sealing device according to an embodiment of the present invention includes a release base member 1 and a double-side adhesive layer 2. The release base member 1 is made of a material capable of providing a release effect against adhesives and has an elongated strip shape. The release base member 1 may be rolled into a roll for convenient storage, transportation, and process. The release base member 1 has, along its length, a separation line 13 separating the release base member 1 into a base piece 11 and a pull strip 12. The base piece 11 has a series of protrusions 111 disposed along a main edge of the base piece 11, protruding perpendicularly to the main edge of the base piece 11. The protrusions 111 may have various shapes and are disposed apart at equal intervals. The base piece 11 has a width greater than that of the pull strip 12.

Figure 2:
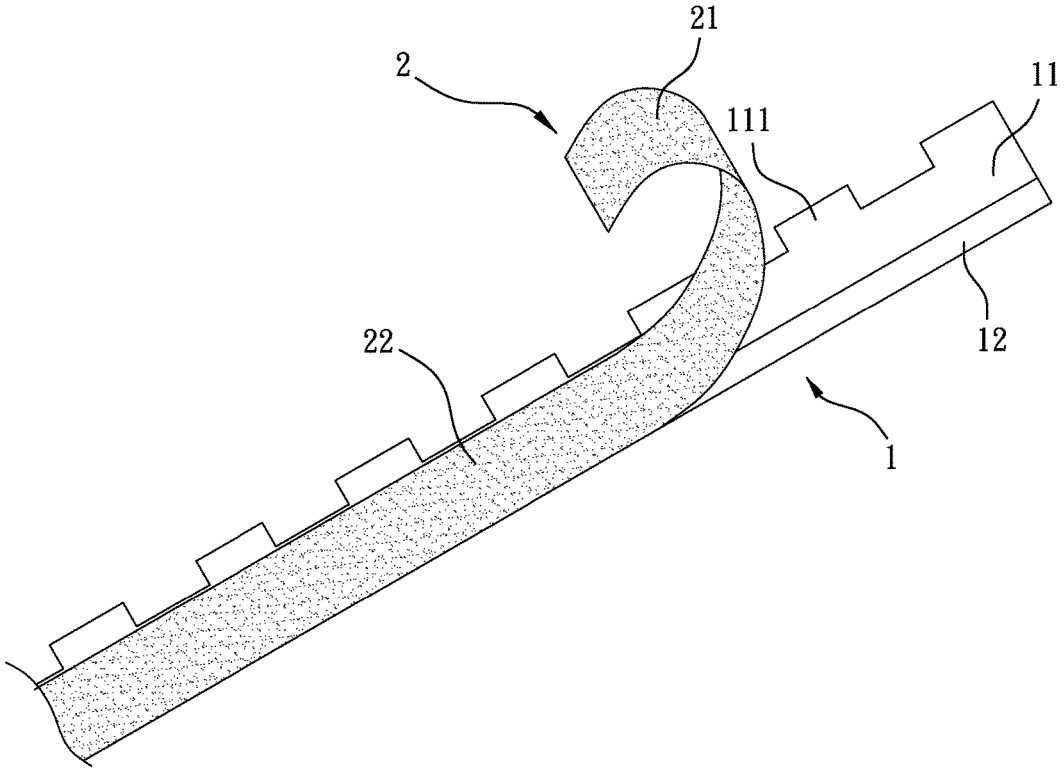
FIG. 2 is a perspective diagram showing a double-sided adhesive layer attached to the release base member of FIG. 1.

The double-sided adhesive layer 2, as shown in FIG. 2, includes a first adhesive piece 21 and a second adhesive piece 22 on two opposing major sides of the double-side adhesive layer 2, respectively. The first adhesive piece 21 is for adhering a major side of the release base member 1. In the present embodiment, the first adhesive piece 21 covers a majority portion of the base piece 11 and the entire pull strip 12. The protrusions 111 are not covered by the first adhesive piece 21.

Figure 3:
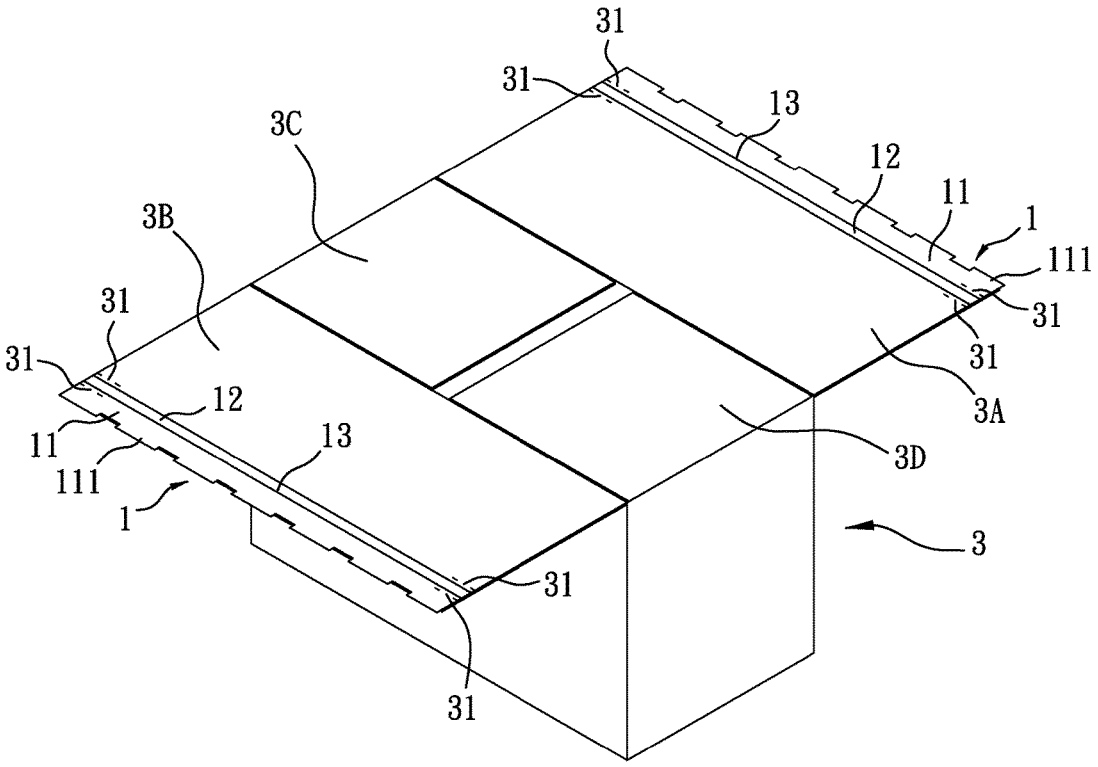
FIG. 3 is a perspective diagram showing two release base members of FIG. 1 adhered to two major flaps of a carton, respectively.

The sealing device is applied as follows. As shown in FIG. 3, a carton 3 has a top opening. A first major flap 3A and a second major flap 3B are connected to two opposing edges of the carton 3's top opening, respectively. A first minor flap 3C and a second minor flap 3D are connected to another two opposing edges of the carton 3's top opening, respectively. Each of the first and second major flaps 3A and 3B has a front portion of its inner side adhered to the second adhesive piece 22 of a sealing device. The front portion mentioned above has two perforated lines 31 of appropriate length along and parallel to two major edges of the pull strip 12, respectively.

Figure 4:
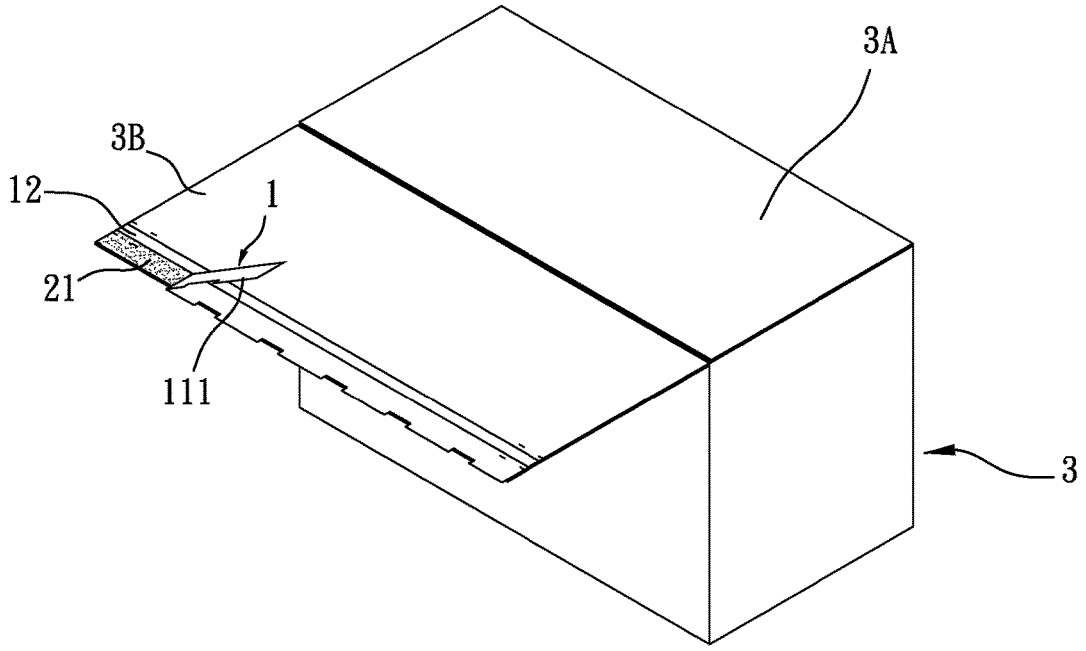
FIG. 4 is a perspective diagram showing a base piece peeled off a release base member on a second major flap of FIG. 3.
Figure 5:
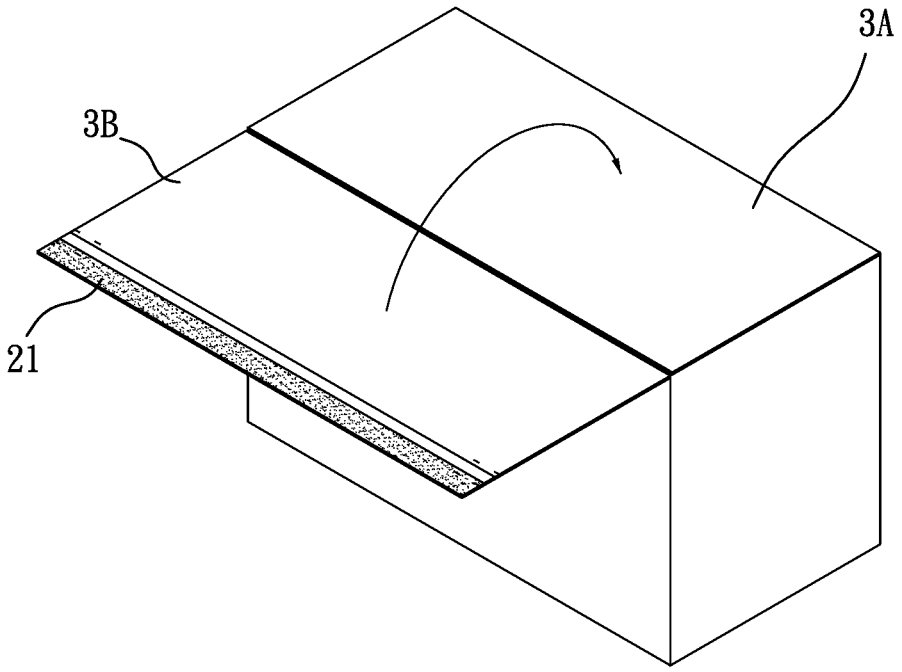
FIG. 5 is a perspective diagram showing the second major flap of FIG. 4 after the base piece is peeled off its release base member.

To package the carton 3, the first and second minor flaps 3C and 3D are folded to cover the top opening. Then the first major flap 3A covers the first and second minor flaps 3C and 3D. The base piece 11 on the second major flap 3B is torn off along the separation line 13 to reveal the first adhesive piece 21, as shown in FIGS. 4 and 5. As the protrusions 111 are not attached to double-sided adhesive layer 2, the base piece 11 therefore may be conveniently torn off by pulling the protrusions 111. The second major flap 3B is then folded to cover the first major flap 3A, and first adhesive piece 21 on the second major flap 3B is adhered to the first major flap 3A. The carton 3 is as such packaged.

Figure 6:
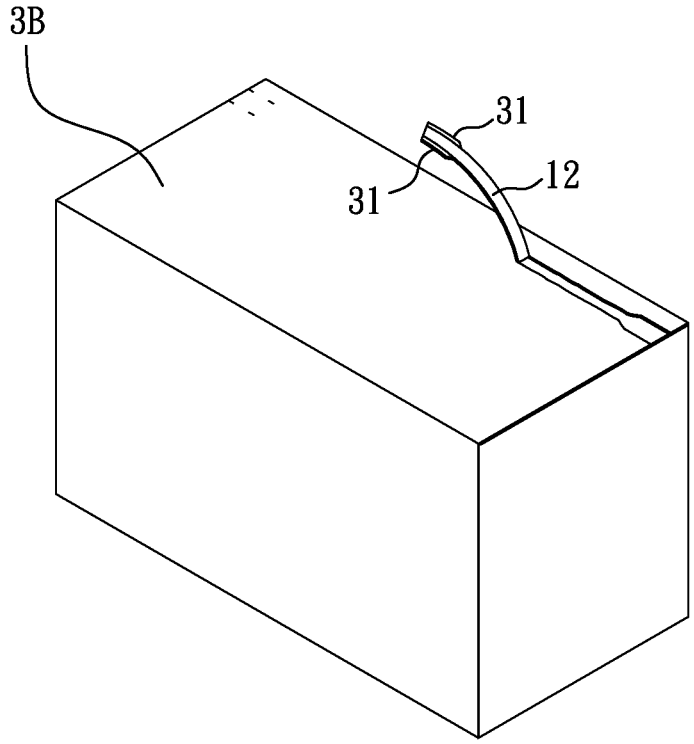
FIG. 6 is a perspective diagram showing, to open a carton, a pull strip is pulled from the second major flap of FIG. 5.
Figure 7:
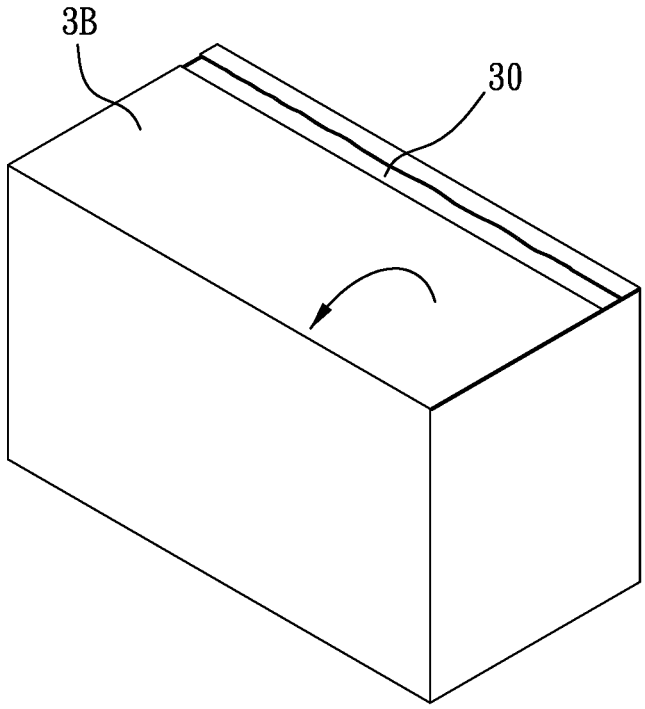
FIG. 7 is a perspective diagram showing the pull strip of FIG. 6 is completely pulled off the second major flap of the carton.

As shown in FIG. 6, to open a sealed carton 3, the pull strip 12 between the two perforated lines 13 on the second major flap 3B is pulled along the length of the release base member 1 until the pull strip 12 is completely torn off the second major flap 3B as shown in FIG. 7. The second major flap 3B is now partitioned by an elongated gap 30 into two parts and a part of the second major flap 3B now can be freely unfolded to open the carton 3.

Figure 8:
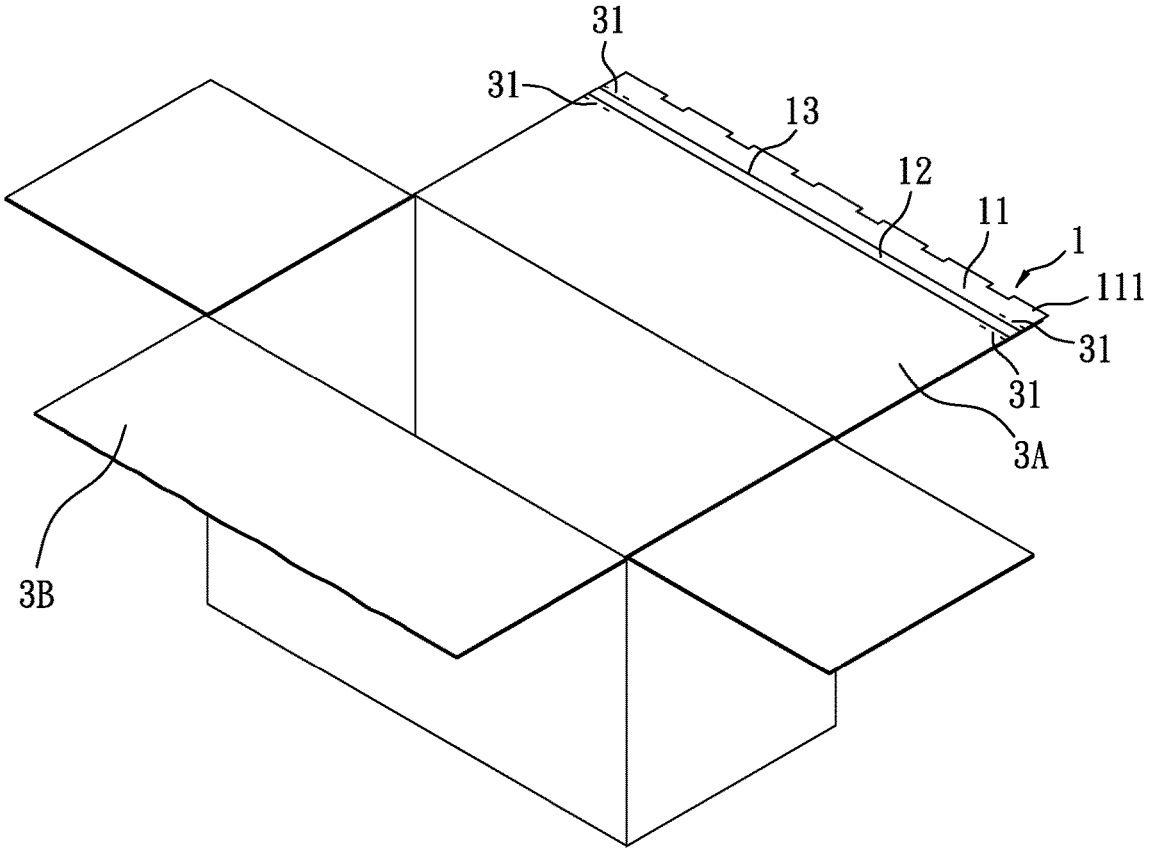
FIG. 8 is a perspective diagram showing minor flaps of the carton of FIG. 6 are unfolded.
Figure 9:
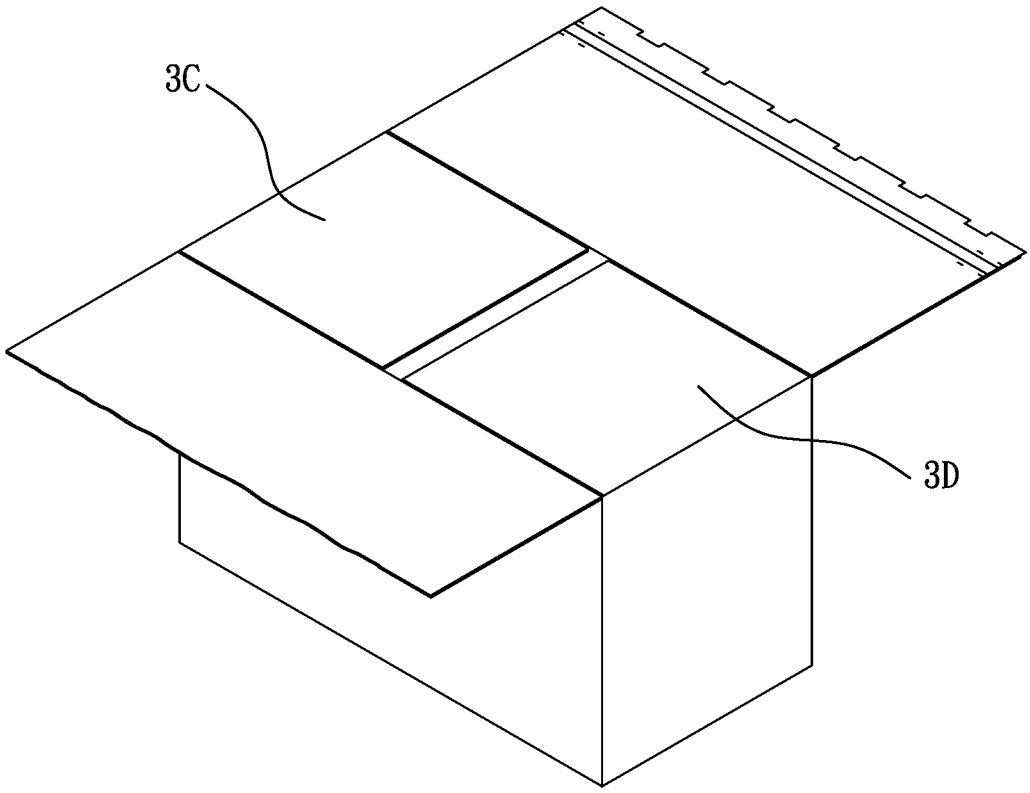
FIG. 9 is a perspective diagram showing, to reuse the carton of FIG. 8, minor flaps of the carton are folded.
Figure 10:
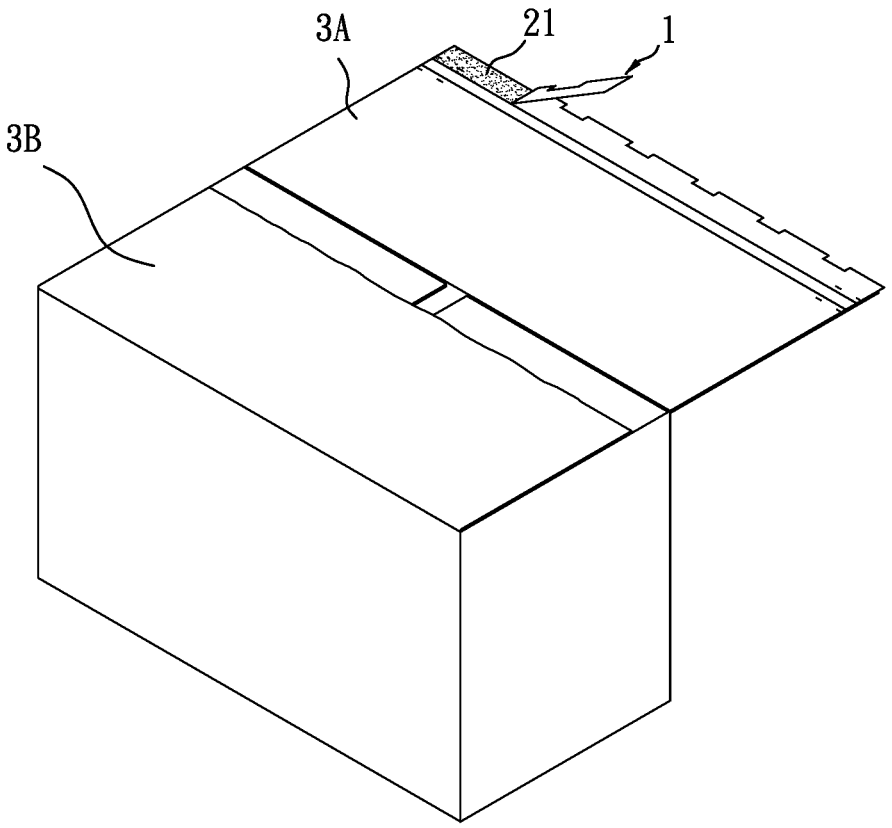
FIG. 10 is a perspective diagram showing a base piece peeled off a release base member on a first major flap of FIG. 9.
Figure 11:
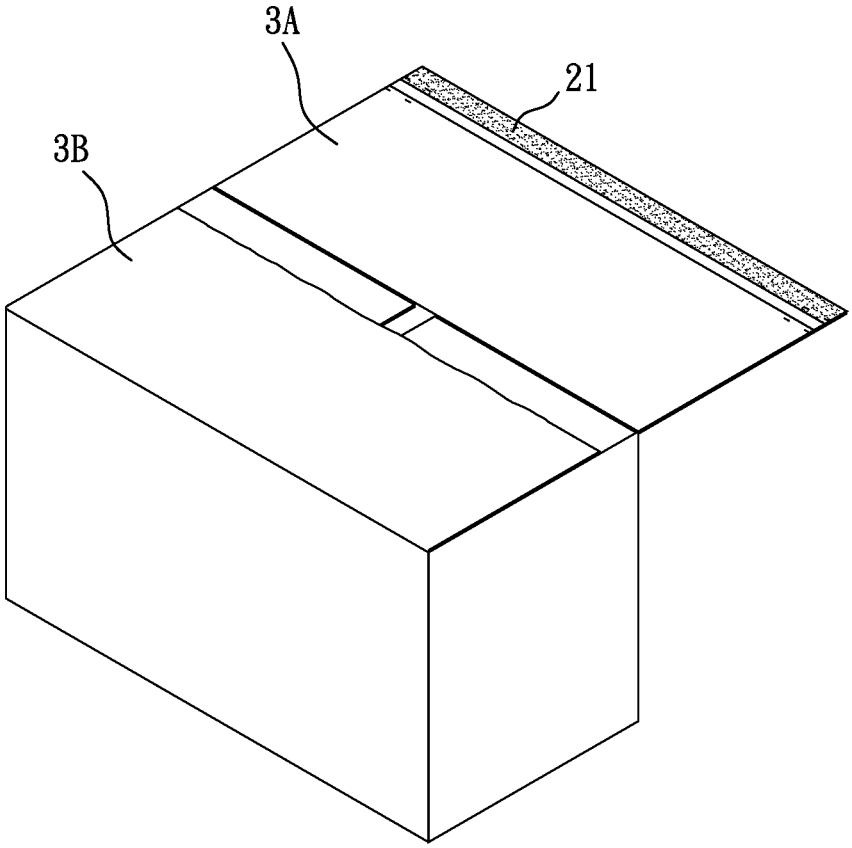
FIG. 11 is a perspective diagram showing the first major flap of FIG. 10 after the base piece is peeled off its release base member.
Figure 12:
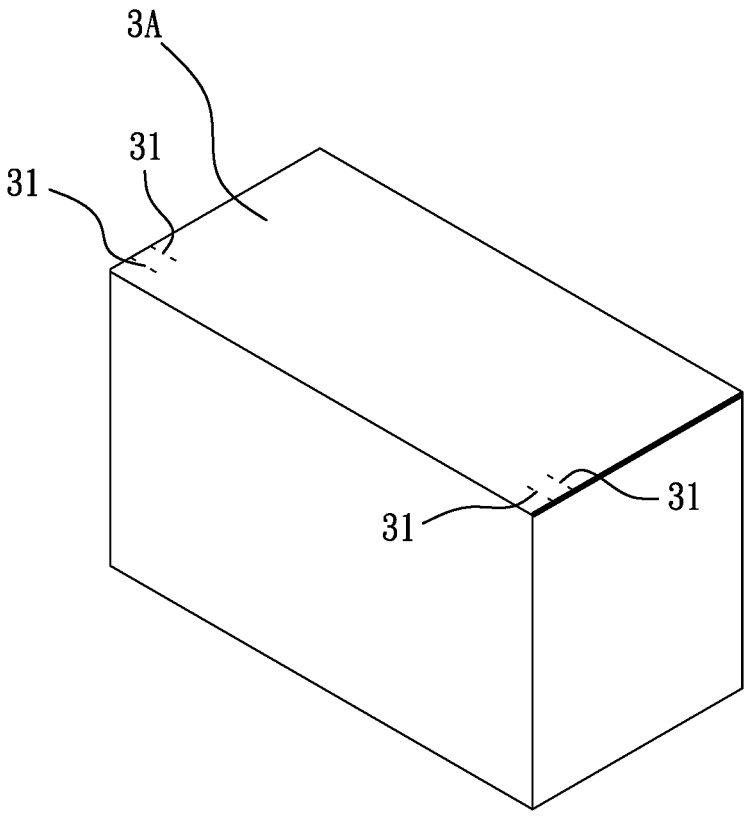
FIG. 12 is a perspective diagram showing the first major flap of FIG. 11 is folded to seal the carton.

The second major flap 3B is now destroyed and cannot be used again. To reuse the carton 3 for packaging, as shown in FIG. 8, the flaps 3A, 3B, 3C, and 3D are opened and products to be packaged are placed in the carton 3. Then, again the first and second minor flaps 3C and 3D are folded to cover the top opening of the carton 3 as shown in FIG. 9. Then the second major flap 3B covers the first and second minor flaps 3C and 3D. The base piece 11 on the first major flap 3A is torn off along the separation line 13 to reveal the first adhesive piece 21, as shown in FIGS. 10 and 11. The first major flap 3A is then folded to cover the second major flap 3B, and first adhesive piece 21 on the first major flap 3A is adhered to the second major flap 3B as shown in FIG. 12. The carton 3 is as such reused. Similarly, to open a sealed carton 3, the pull strip 12 between the two perforated lines 13 on the first major flap 3A is pulled along the length of the release base member 1 until the pull strip 12 is completely torn off the first major flap 3A. The first major flap 3A is partitioned into two parts and a part of the first major flap 3A now can be freely unfolded to open the carton 3.

Please note that the carton 3 may also has a bottom opening sealed by separate sets of major and minor flaps (not sown) using the same sealing devices. In other words, four sealing devices may be applied respectively to the major and minor flaps at the carton 3's top and bottom openings. The carton 3 therefore can be used for packaging up to four times.

Figure 13:
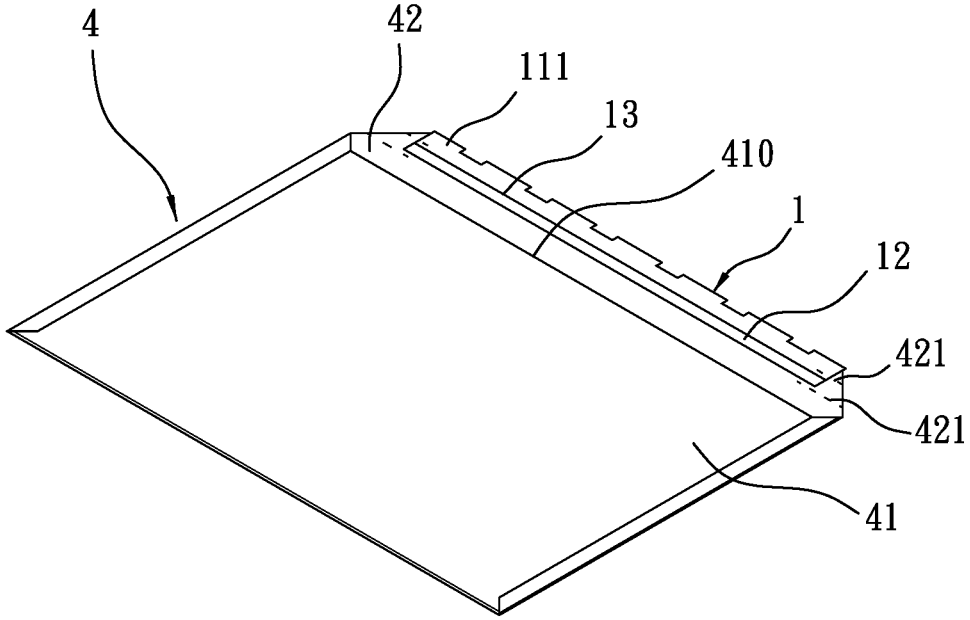
FIG. 13 is a perspective diagram showing a sealing device of the present invention applied to an envelope.

The sealing device may also be applied to seal envelopes commonly used by postal or express delivery services. As shown in FIG. 13, an enveloped 4 includes an enclosure member 41 and a flap 42 at an opening 410 of the enclosure member 41. The flap 42 has a front portion of its inner side adhered to the release base member 1 of a sealing device. The front portion has two perforated lines 421 of appropriate length along and parallel to two major edges of the pull strip 12, respectively.

Figure 14:
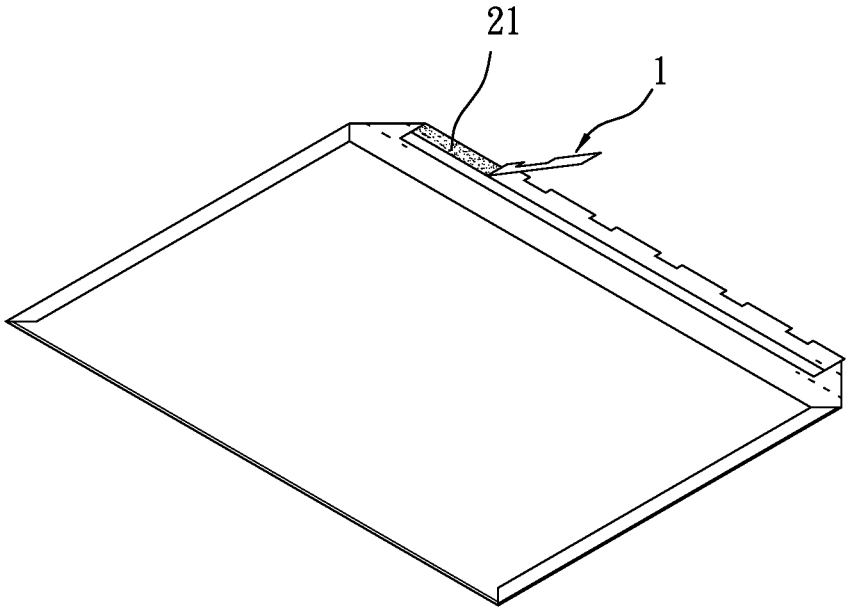
FIG. 14 is a perspective diagram showing a base piece peeled off a release base member on a flap of FIG. 13.
Figure 15:
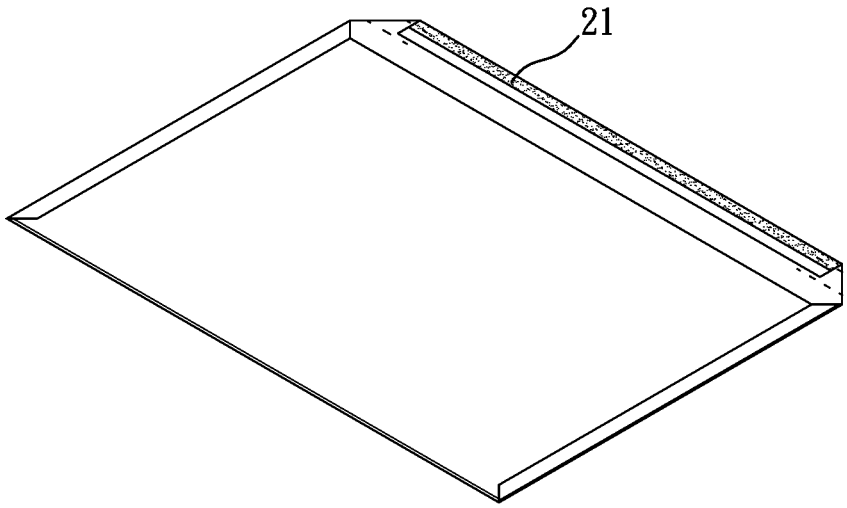
FIG. 15 is a perspective diagram showing the flap of FIG. 14 after the base piece is peeled off its release base member.
Figure 16:
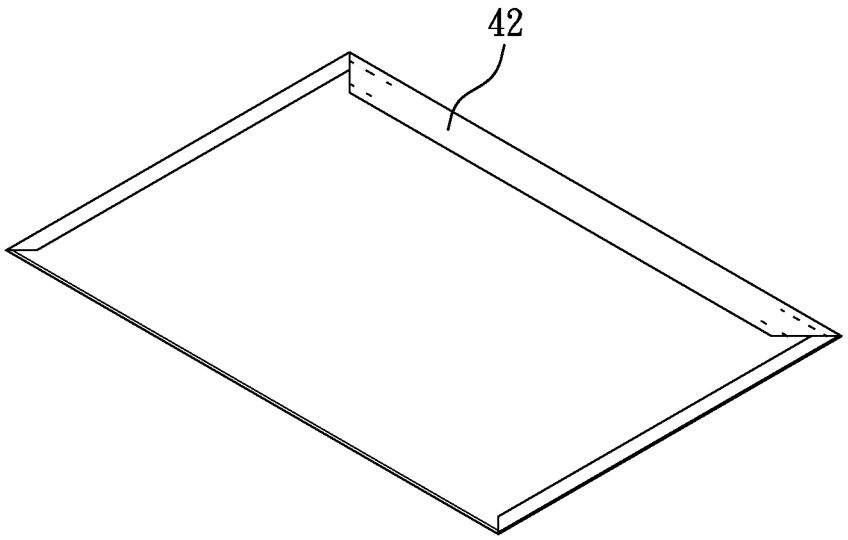
FIG. 16 is a perspective diagram showing the flap of FIG. 15 is folded to seal the envelope.
Figure 17:
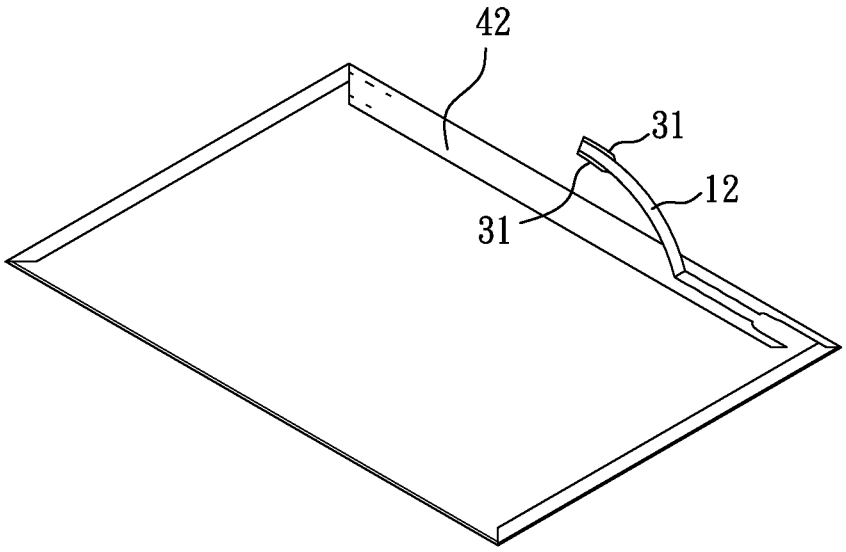
FIG. 17 is a perspective diagram showing, to open the envelope, a pull strip is pulled from the flap of FIG. 16.
Figure 18:
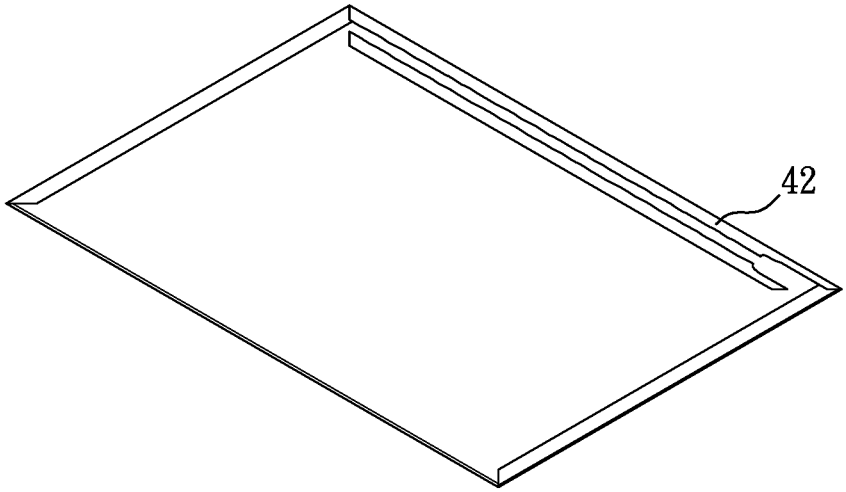
FIG. 18 is a perspective diagram showing the flap of FIG. 17 after the base piece is peeled off its release base member.
Figure 19:
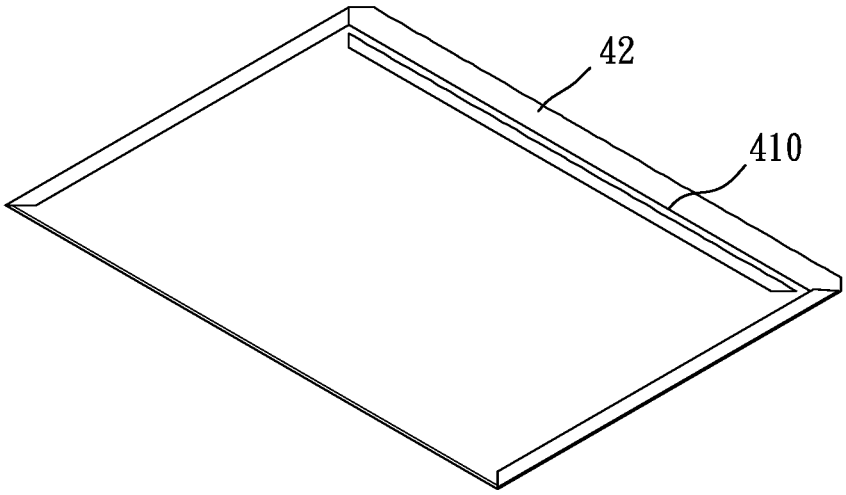
FIG. 19 is a perspective diagram showing the flap of FIG. 16 is unfolded to open the envelope.

As shown in FIGS. 14 and 15, to seal the envelope 4, the base piece 11 of the release base member 1 is torn off to reveal the first adhesive piece 21. The flap 42 is then folded so that the first adhesive piece 21 is adhered to the enclosure member 41 as shown in FIG. 16. To open the envelope 4, similarly, the pull string 12 between the perforated lines 421 is pulled from an end of the flap 42 along the length of the release base member 1, as shown in FIG. 17, until the pull strip 12 is completely off the flap 42 as shown in FIG. 18. The opening 410 of the envelope 4 is as such revealed as shown in FIG. 19.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A sealing device for a paper-based container, comprising a release base member of an elongate shape having a separation line along a length of the release base member separating the release base member into a base piece and a pull strip; and a double-sided adhesive layer having a first adhesive piece and a second adhesive piece on two major sides of the double-sided adhesive layer, respectively;

wherein the first adhesive piece is for adhering a major side of the release base member; the second adhesive piece is for adhering a front portion of a flap of the paper-based container; and, to apply the flap to seal the paper-based container, the base piece is removed from the release base member to reveal the first adhesive piece; and a plurality of protrusions are configured along a major edge of the base piece protruding perpendicularly to the major edge.

2. The sealing device according to claim 1, wherein the base piece has a width greater than that of the pull strip.

3. The sealing device according to claim 2, wherein the first adhesive piece covers the pull strip entirely and the base piece partially.

4. The sealing device according to claim 3, wherein the protrusions are not covered by the first adhesive piece.

5. The sealing device according to claim 1, wherein the flap has two perforated lines of appropriate length along and parallel to two major edges of the pull strip, respectively.

* * * * *